United States Patent [19]

Square

[11] Patent Number: 4,924,531

[45] Date of Patent: May 15, 1990

[54] RESILIENTLY SUPPORTED TOILET SEAT

[76] Inventor: Nick J. Square, 6410 Middle Ridge Rd., Madison, Ohio 44057

[21] Appl. No.: 128,059

[22] Filed: Dec. 3, 1987

[51] Int. Cl.[5] ..... A47K 13/10

[52] U.S. Cl. ..... 4/251; 4/480; 297/DIG. 10

[58] Field of Search ..... 4/251, 234, 237, 253, 4/661, 480, 252 R; 297/338, 345, DIG. 10

[56] References Cited

U.S. PATENT DOCUMENTS 362,424 5/1887 Burrows ..... 4/251
3,158,398 11/1964 Stryker ..... 4/237
3,473,174 10/1969 Cool ..... 4/251
4,168,552 9/1979 Austin ..... 4/251
4,872,223 10/1989 Baird ..... 4/480

*Primary Examiner*—Henry J. Recla
*Assistant Examiner*—Casey Jacyna
*Attorney, Agent, or Firm*—Frank B. Robb

[57] ABSTRACT

A toilet and seat construction to provide for use by a person, to resiliently assist in raising and lowering the person from sitting to standing position, and vice versa, including a framework to guide the movement of a seat support member and provide means to grasp at each side to facilitate such movement.

7 Claims, 1 Drawing Sheet

RESILIENTLY SUPPORTED TOILET SEAT

BACKGROUND OF THE DISCLOSURE

This invention relates to a toilet and seat construction which is particularly useful for invalids, inasmuch as it provides means to raise and lower a person from a sitting position for using of a toilet, without the usual exertion which may be accompanied thereby, as for example when a person is weakened from whatever cause and requires the use of the toilet.

It is contemplated that a seat construction arranged in relation to a toilet and supported by suitable means, will be mounted in such a manner that the application of a certain amount of weight will permit the seat to move into using position and upon the release of some of the weight assist a person in rising from sitting position and thus take into account the relative strength of such individual as may be required.

As far as I am aware there is nothing of a similar nature available that is fixed or suitably arranged with regard to a toilet in such a manner that it does act in this way as before described to positively provide for proper movement of the seat and to assist in raising and lowering an individual who uses the same.

It will be understood that this arrangement is particularly useful in hospitals or other invalid locations, where it is necessary for persons to sit on and rise from a toilet in the use thereof.

Under the circumstances it is believed that a useful and valuable device is provided for invalid use, and that whereas it is intended to be used in hospitals or other invalid locations, it is also singularly adaptable for home or other use where it fits into the overall demands of toilet use.

GENERAL DESCRIPTION OF THE INVENTION

As before suggested, the invention does in fact contemplate the provision of a toilet and seat combination wherein the seat itself is operable in a somewhat different manner from the usual toilet seat construction in that it moves upwardly and downwardly in a somewhat planar fashion so that it can be guided in its movement and is suspended in such a manner that a resilient construction of support is availed of to partially offset the weight of a person using such toilet and assist thereby in lowering such person to using position.

By the same token the arrangement of the framework which carries the support for the toilet seat so that by relieving some of the weight applied to the toilet seat, the resilient mounting will assist the person in rising and thus not place the entire burden on the muscles of such person, in effect providing an assistance which would have to otherwise probably be provided by an individual.

It is thus seen to be a desired addition to any location wherein assistance for using of a toilet is in fact desirable or necessary.

SPECIFIC CONSTRUCTION OF THE DISCLOSURE

Referring to the disclosure of the drawing, it is notable that the several figures thereof provide views which disclose the same and include the following:

Figure 1:
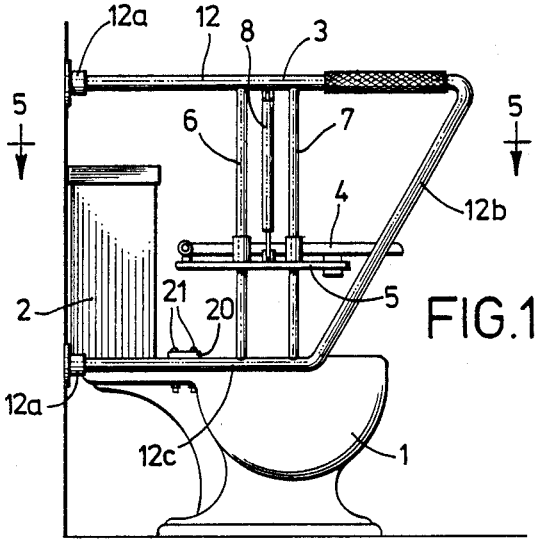
FIG. 1 is a side elevational view of the general arrangement of the concept hereof showing the toilet seat in initial or upward position prior to use thereof.

Turning now to a consideration of these figures, a common form of toilet including a bowl 1 and a tank 2 mounted thereon and fastened thereto, is shown in position and the framework which involves the support for the seat designated 3 in general, a seat 4 being suggested and a support 5 therefore indicated likewise, the support 5 being arranged in connection with vertical guide tubes such as 6 and 7 with a resilient support unit designated 8 connected to the upper portion of the framework 3 and to the seat support member 5.

Figure 2:
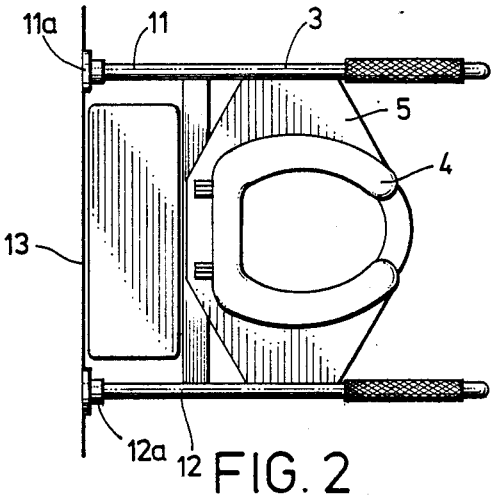
FIG. 2 is a top plan view showing the arrangement of the framework and toilet seat with support therefor in relation to a toilet of conventional form.
Figure 3:
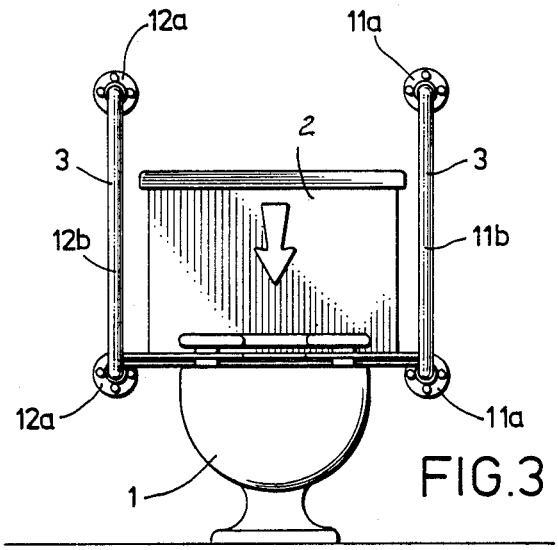
FIG. 3 is a front view showing the toilet seat in the lower most position as though being used.

As will be observed in FIG. 2 for example, the seat support member 5 is shown as having the seat 4 fastened thereto, for movement therewith, the seat support member spanning the toilet bowl 1 and connected as indicated in FIG. 1 and subsequent figures for guiding movement with respect to the framework 3.

The framework 3 is noted as comprising identical side members 11 and 12, spaced from the side of the toilet itself and fastened by suitable flanges **11*a* and 12*a* to the wall such as indicated at 13**.

Figure 4:
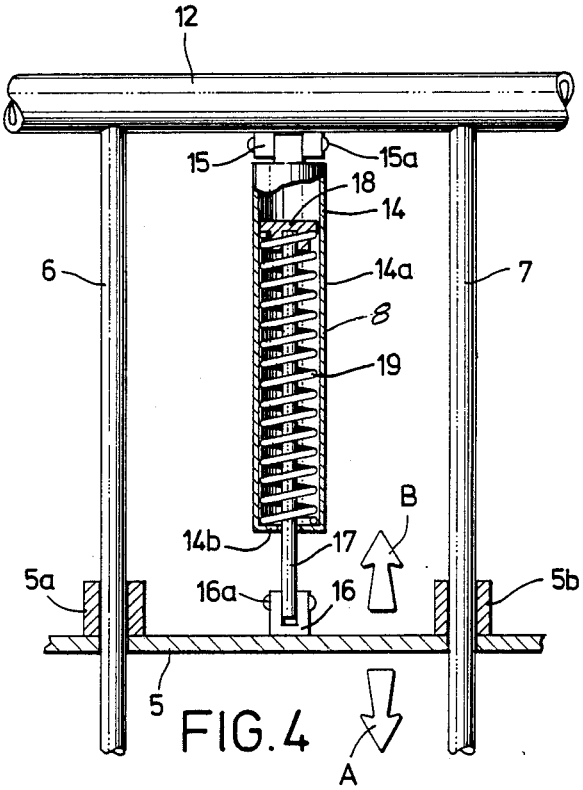
FIG. 4 is a detailed enlarged view showing a resilient mount for the seat support of this concept.
Figure 5:
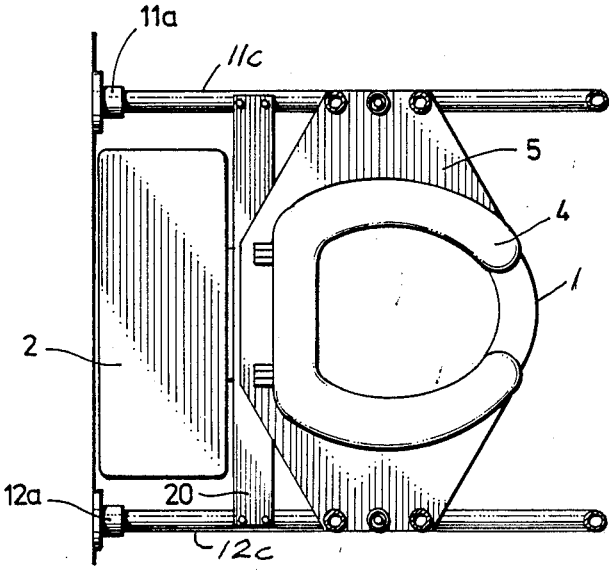
FIG. 5 is a plan view taken about on the line 5—5 of FIG. 1 to show certain guiding details of the support and seat with relation to the toilet about which the construction is mounted.

The framework is a sort of trapezoidal unit or at least the individual side elements are trapezoidal in shape including the downwardly extending tubes or tubular portions **12*b* for example and a horizontal lower element 12*c*, the frame elements at both sides being identical as before explained and thus not further referred to in detail except to point out that as shown in FIG. 4 the upper horizontal tubular part 12 for example, is intended to be fastened to the vertically extending guide tubes 6 and 7 which are in turn fastened as noted in FIG. 1 for example to the bottom tube part 12*c*** for example.

FIG. 4 discloses the resilient unit 8 including a housing 14 which is connected at its upper end by a pivot mount 15 and a pivot **15*a* similarly connected by mount 16 and pivot 16*a* to a rod 17 and thereby fastened to the support member 5**.

Guide bushings **5*a* and 5*b* are provided to guide the support member 5 in its upward and downward motion, the resilient unit 8 arranged to provide resilient support, this being in turn effected by piston rod 17 which has a head 18 at its upper end and a spring 19 surrounding the rod engaging the bottom 14*b* of the tubular housing 14*a***.

Thus it will be seen that application of downward pressure as suggested by the arrow A of FIG. 4 will compress the spring 19 and thus load the same so that upon some relief of the weight applied will assist in raising the support member 5 again, in the direction of the arrow 8.

It is obvious that a resilient unit such as 8 is provided at each side of the frame 3 so as to uniformly bear the weight of the seat, the support member and any person applied thereto.

It will be understood that whereas a toilet of conventional construction is shown involving a tank and bowl 2 and 1 respectively, there may also be substituted therefore a different type of toilet without using the tank 2.

From the foregoing it will be apparent that since the seat support 5 will be positioned normally as shown in FIG. 1, so that when a person's weight is applied to the support member, through the seat 4 carried thereby, such person will be assisted in lowering the body weight to the toilet using position. Subsequently by slight release of the weight or overcoming some of the weight by the individual using the upper elements 11 and 12 of the framework 3, the resilient units 8 will assist in raising the weight of such person, in the desired manner.

It is clear that the spring construction may be of any suitable form so that it functions as before described that shown being preferred. Also that shown may be of varying resilience for light or heavy persons as the case may be.

In order to stiffen the entire structure and maintain the same particularly the side frame units in relation to the toilet and also the support member 5, a suitable transverse flat member 20 may be fastened to the toilet in the usual bolt holes provided for the seat hinge and suggested at 21 and also to the lower elements 11c and 12*c* of the side frames 11 and 12.

I claim:

1. A toilet and seat support construction, comprising a toilet having a toilet bowl, a seat support member carried by a framework fixed separately from and with respect to said bowl, said member having a seat area, means to slidably position said support member for bodily non-tilting vertical upward and downward movement of the member when the weight of a person is imposed on and relieved from said seat area and said position means further including biasing means for biasing said support member toward said upward movement.

2. The combination as claimed in claim 1, wherein the means to slidably position said support member include parts arranged to balance the weight of a person imposed on said seat in a manner to lower said member gently.

3. A combination as claimed in claim 2, wherein the means to slidably position said support member, will also raise a person using said seat when a portion of the person's weight is in part reduced by such person lifting himself slightly.

4. The combination as claimed in claim 1, wherein a framework extends at both sides of the toilet bowl, the support member extends across the bowl and is connected to the framework to move vertically therewithin.

5. The combination as claimed in claim 4, wherein said biasing means comprising spring units connected to the framework and support member to provide resilient movement of said member.

6. The combination as claimed in claim 4, wherein said biasing means comprises spring units connected to the framework and support member to provide resilient movement of said member, and means are provided to guide the support member upwardly and downwardly bodily in a uniform vertical path.

7. The combination as claimed in claim 4, wherein said biasing means comprises spring units connected to the framework and support member to provide resilient movement of said member, and means are provided to guide the support member bodily upwardly and downwardly in a uniform path, said means comprising tubular guide members connected to the framework and engaged with opposite ends of the support member to effect the guiding action aforesaid.

* * * * *